US007355168B2

(12) United States Patent
Yamaguchi

(10) Patent No.: US 7,355,168 B2
(45) Date of Patent: Apr. 8, 2008

(54) TIME OF FLIGHT MASS SPECTROMETER

(75) Inventor: Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 261 days.

(21) Appl. No.: 11/353,112

(22) Filed: Feb. 14, 2006

(65) Prior Publication Data

US 2006/0192110 A1 Aug. 31, 2006

(30) Foreign Application Priority Data

Feb. 15, 2005 (JP) ..... 2005-037132

(51) Int. Cl.
*H01J 49/40* (2006.01)

(52) U.S. Cl. ..... 250/282; 250/287

(58) Field of Classification Search ..... 250/282, 250/287, 294, 296, 298
See application file for complete search history.

(56) References Cited

U.S. PATENT DOCUMENTS

| | | | | |
|---|---|---|---|---|
| 6,949,736 | B2 * | 9/2005 | Ishihara | 250/282 |
| 7,211,792 | B2 * | 5/2007 | Yamaguchi et al. | 250/287 |
| 2005/0092913 | A1 * | 5/2005 | Ishihara | 250/287 |
| 2005/0151076 | A1 * | 7/2005 | Yamaguchi et al. | 250/291 |
| 2005/0187677 | A1 * | 8/2005 | Walker | 701/16 |
| 2006/0214100 | A1 * | 9/2006 | Verentchikov et al. | 250/287 |
| 2006/0219890 | A1 * | 10/2006 | Yamaguchi | 250/287 |
| 2007/0045527 | A1 * | 3/2007 | Ogawa et al. | 250/281 |
| 2007/0114383 | A1 * | 5/2007 | Ueno | 250/287 |
| 2007/0176090 | A1 * | 8/2007 | Verentchikov | 250/287 |
| 2007/0194223 | A1 * | 8/2007 | Sato et al. | 250/287 |

FOREIGN PATENT DOCUMENTS

JP 11-195398 7/1999

OTHER PUBLICATIONS

M. Ishihara et al., "Perfect space and time focusing ion optics multiturn time of flight mass spectrometers", International Journal of Mass Spectrometry, vol. 197, 2000, pp. 179-189.

(Continued)

*Primary Examiner*—Jack I. Berman
*Assistant Examiner*—Johnnie L Smith, II
(74) *Attorney, Agent, or Firm*—Westerman, Hattori, Daniels & Adrian, LLP.

(57) ABSTRACT

The present invention provides a time of flight mass spectrometer having an ion optics forming a multi-turn track, which is capable of time-focusing the ions while allowing the multi-turn track to be configured in an unlimited and highly variable manner. In a specific form of the invention, a reflector 9 is provided on the flight path between the position where the ions leave the loop orbit P and the ion detector 10 located outside the loop orbit P, and the condition of the electric field generated by the reflector 9 is appropriately determined. Thus, even if the ions cannot be well time-focused by the ion optics 2 creating the sector-shaped electric fields 4 and 7, it is possible to compensate the time-focusing performance with the reflector 9 to achieve a good performance of time-focusing of the ion throughout the overall system wherein the ions leave the ion source 1 and finally reach the ion detector 10. Thereby, the ions can reach the ion detector 10 at approximately the same time even if the ions having the same mass number have different levels of energy at the moment they leave the ion source 1.

6 Claims, 3 Drawing Sheets

OTHER PUBLICATIONS

W. P. Poshenrieder, "Multiple-Focusing Time-of-Flight Mass Spectrometers Part II TOFMS With Equal Energy Acceleration", Int. J. Mass. Spectrom. Ion Phys., vol. 9, 1972, pp. 357-373.
T. Sakurai et al., "Ion Optics For Time-of-Flight Mass Spectrometers With Multiple Symmetry" Int. J. Mass Spectrom. Ion Process., vol. 63, 1985, pp. 273-287.
B. A. Mamyrin et al., "The Mass-Reflectron, A New Nonmagnetic Time-of-Flight Mass Spectrometer With High Resolution", Sov. Phys. JEPT, vol. 37 No. 1, 1973, pp. 45-48.
H. Matsuda, "Improvement of a TOF Mass Spectrometer with Helical Ion Trajectory", J. Mass Spec. Soc. Jpn., vol. 49 No. 6, 2001, pp. 227-228.

* cited by examiner

TIME OF FLIGHT MASS SPECTROMETER

The present invention relates to a time of flight mass spectrometer having a flight space in which ions to be analyzed repeatedly fly substantially the same loop orbit or a reciprocal path.

BACKGROUND OF THE INVENTION

In a time of flight mass spectrometer (TOF-MS), ions accelerated by an electric field are injected into a flight space where no electric field or magnetic field is present. The ions are separated by their mass numbers according to the flight time until they reach a detector and are detected thereby. Since the difference of the lengths of flight time of two ions having different mass numbers is larger as the flight path is longer, it is preferable to design the flight path as long as possible in order to enhance the mass number resolution of a TOF-MS.

In many cases, however, it is difficult to incorporate a long straight path in a TOF-MS due to the limited overall size, so that various measures have been taken to effectively lengthen the flight length. In the Japanese Unexamined Patent Publication No. H11-195398 (called "Patent Document 1" hereinafter), an "8" shaped orbit is formed using two or four sector-shaped electric fields, and the ions are guided to fly repeatedly in the "8" shaped orbit many times, whereby the effective flight length is elongated.

In general, the time-focusing and space-focusing of ions are important for a TOF-MS to perform analyses with high accuracy, as pointed out in Patent Document 1 or by Ishihara et al. ("Perfect space and time focusing ion optics for multiturn time of flight mass spectrometers", International Journal of Mass Spectrometry, 197(2000), pp. 179-189). It is said that, even if the ions leave the same position into different directions with different levels of energy, they can simultaneously reach the same position as long as they satisfy the aforementioned two focusing conditions, although they differ in flight direction and energy level. In actual analyses, however, the space-focusing condition does not need to be very tight if the object of the analysis is to measure the ion strength with respect to the mass number of the ion. This is because the ion detector, whose detecting surface has a certain area, is able to detect the ions even if they do not reach the same position on the detecting surface. Therefore, time-focusing is more important.

Patent Document 1 claims that the ion optics constituting the loop orbit in the TOF-MS described therein is capable of achieving the time-focusing of ions by disposing sector-shaped electric fields in double symmetry. This configuration attempts the time-focusing of ions within the multiple loop orbit, whereas it gives no consideration to the flight path along which the ions released from the ion source travel until they enter the multiple loop orbit or the flight path along which the ions that have flown the multiple loop orbit predetermined times and left the multiple loop orbit travel until they reach the ion detector. Thus, the analysis cannot always be carried out with adequate accuracy.

The main object of the present invention is therefore to provide a time of flight mass spectrometer capable of creating an improved mass spectrum and calculating the mass number of each ion from the-spectrum with high accuracy.

SUMMARY OF THE INVENTION

According to the present invention, a time of flight mass spectrometer includes:

an electric field generator for creating a loop type or reciprocal type of multi-turn track for causing the ions to travel in substantially the same path one or more times;

an ion source located on or out of the multi-turn track at which the ions begin to fly;

an ion detector located out of the multi-turn track for detecting the ions that have traveled in the multi-turn track one or more times and left the multi-turn track; and a compensator, located between the position at which the ions leave the multi-turn track and the ion detector or between the ion source and the position at which the ions enter the multi-turn track, for compensating the focusing of ions so as to achieve the time-focusing of the ions throughout the overall flight path along which the ions travel after leaving the ion source until reaching the ion detector.

The multi-turn track created by the electric field generator may have any form as long as it allows ions to repeatedly fly along approximately the same orbit or path to have a long flight distance even within a small flight space. For example, it may be a circular, elliptical or "8" shaped loop orbit, or it may be a linear or curved reciprocal path. The ion source used hereby does not need to have a means for generating ions from molecules or atoms; it may be any device as long as it can serve as a starting point from which the ions are extracted and then introduced into the flight space.

In the TOF-MS according to the present invention, the flight path along which the ions travel after leaving the ion source until reaching the ion detector can be divided into three sections: a multi-turn track created by the electric field generator; an injection path along which the ions that have left the ion source travel until they enter the multi-turn track; and the ejection path along which the ions that have left the multi-turn track travel until they reach the ion detector. It should be noted that the ion source may be located on the multi-turn track, in which case there is practically no injection path present, meaning that the ions enter the multi-turn track upon being released from the ion source.

Unlike the mass spectrometer described in Patent Document 1, the multi-turn track used in the present invention does not need to have a time-focusing capability. This allows the electric field generator to have a highly variable configuration because it now does not need to employ such a special configuration that includes a plurality of sector-shaped electric fields disposed in double symmetry. In the present invention, instead, the compensator for appropriately deflecting the flight path of the ions through an electric field is provided on the ion path between the position at which the ions leave the multi-turn track and the detector or on the ion path between the ion source and the position at which the ions enter the multi-turn track. An example of the compensator is a reflector that creates an electric field to reflect the oncoming ions. Another example is an electrode assembly for creating a sector-shaped electric field.

When ions that are not focused with respect to the temporal position, angle and energy are injected into the compensator as described above, they are differently affected by the electric field according to the difference in temporal position, angle or energy. The dispersion is corrected by a slight change of the flight path, such as a shift in the position at which the ion is reflected and a change in the curvature of the curved path along which the ion flies. Thus, the ions will be time-focused when they finally reach the detector.

As mentioned earlier, the configuration of the electric field generator is to be rather limited in order to achieve the time-focusing within the multi-turn track, whereas, according to the TOF-MS of the present invention, the configuration of the multi-turn track has a large degree of freedom and the time-focusing can be achieved throughout the overall system from the ion source to the ion detector by a relatively simple configuration, i.e. by merely adding the compensating means to a portion out of the multi-turn track. Accordingly, the ions having the same mass number reach the detector at approximately the same time, thereby yielding a preferable mass spectrum and improving the accuracy of qualitative analysis and quantitative analysis based on the spectrum.

DETAILED DESCRIPTION OF A PREFERRED EMBODIMENT

Figure 1:
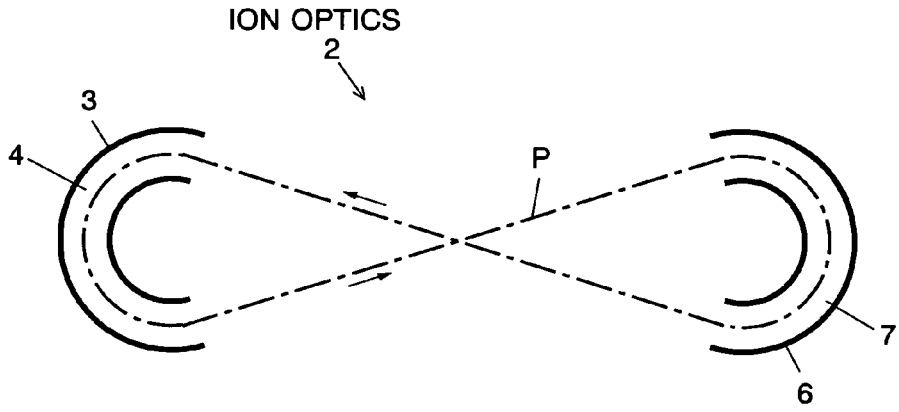
FIG. 1 is a schematic diagram of the ion optics in a TOF-MS as an embodiment of the present invention.

Firstly, the method of expressing an ion path in the following description is specified. The same expressions as in Patent Document 1 are used in order to clarify the contrast with the configuration described therein. Specifically, it is assumed that the ions are injected thorough an injection plane, then carried by an arbitrary type of ion optics including sector-shaped electric fields and finally ejected through an ejection plane. Also, the ion that has a specific amount of energy and a specific mass number and flies along the central path is defined as a reference ion. If an ion has left the injection plane with its position, flight direction (or angle) and energy level being initially shifted from those of the reference ion, the ion will have spatial and temporal divergences from the reference ion flying along the central path when it reaches the ejection plane. The divergences can be approximated by the following linear equations according to a well-known theory of ion optics:

$$X=(x|x)x+(x|a)a+(x|d)d \quad \ldots (1)$$

$$A=(a|x)x+(a|a)a+(a|d)d \quad \ldots (2)$$

$$L=(t|x)x+(t|a)a+(t|d)d \quad \ldots (3)$$

where X is the displacement of the ion at the ejection point along the direction perpendicular to the central path on the orbital plane, A is the divergence in the flight direction (or angle) of the ion at the ejection point, L is the difference in time at the ejection point, x is the initial displacement of the ion at the injection point along the direction perpendicular to the central path on the orbital plane, a is the initial divergence in the flight angle of the ion along the same direction, t is the initial difference in time at the injection point, and d is the initial difference in the energy of the ion at the injection point. In usual cases, the trajectory of the ion on the plane perpendicular to the orbital plane is also essential. In the present invention, however, this trajectory is less important and accordingly ignored. In the above equations, (x|x), . . . , (t|d) are constants specific to the ion optics concerned, each of which is dependent on the elements enclosed in the corresponding parentheses.

Suppose that an ion optics for a TOF-MS includes a closed loop orbit (called the "closed path" hereinafter), as proposed by Poshenrieder (see W. P. Poshenrieder, "Multiple-Focusing Time-Of-Flight Mass Spectrometers Part II TOFMS With Equal Energy Acceleration", Int. J. Mass. Spectrom. Ion Phys. 9(1972), p. 357). In this type of ion optics, an ion that has left the injection point should ideally travel through the closed path and return to the injection point. In such a case, the system can be regarded as a TOF-MS having a closed path in which an ion makes just a single turn. In practice, however, the ion may fly in a closed path multiple times before it returns to the starting point for the first time after its departure. In such a case, the system can be regarded as a TOF-MS having a closed path whose length equals to the distance that the ion travels until it returns to the starting point for the first time after being released. Anyway, the ion optics having a closed path should have properties that satisfy the following spatial conditions:

$$(x|x)=\pm 1 \quad \ldots (4)$$

$$(x|a)=0 \quad \ldots (5)$$

$$(x|d)=0 \quad \ldots (6)$$

as well as the following temporal conditions:

$$(t|x)=0 \quad \ldots (7)$$

$$(t|a)=0 \quad \ldots (8)$$

$$(t|d)=0 \quad \ldots (9)$$

where the symbols used in these equations are identical to those used in equations (1)-(3). Equations (5) and (6) specify the conditions for focusing ions with respect to angle and energy within the space (i.e. double conditions for space-focusing), and equations (7), (8) and (9) express the conditions for time-focusing ions with respect to the position, angle and energy (i.e. triple conditions for time-focusing). As explained previously, only the time-focusing conditions are hereby considered and the space-focusing conditions are ignored.

A TOF-MS composed of two sector-shaped electric fields, which is one of the simplest types of ion optics, is considered as an embodiment of the TOF-MS according to the present invention. FIG. 1 is a schematic diagram of the ion optics 2 in the TOF-MS of the present embodiment, which corresponds to the multi-turn track in the present invention.

As shown in FIG. 1, the ion optics 2 includes electrodes 3 and 6, each of which consists of an inner electrode and an outer electrode having the shape of concentric circles partially sectioned, to create two sector-shaped electric fields 4 and 7 being opposed to each other. The sector-shaped electric fields 4 and 7 cause the ions to repeatedly fly along the "8" shaped loop orbit P one or more times. Regarding this type of ion optics 2, Sakurai et al. have considered a variety of systems having different combinations of two electric fields with a plane symmetric configuration, irrespective of whether its ion path is closed or not, and have consequently proved that there is no ion optics that satisfies the aforementioned temporal conditions (see T. Sakurai, T. Matsuo and H. Matsuda "Ion Optics For Time-Of-Flight Mass Spectrometers With Multiple Symmetry" Int. J. Mass Spectrom. Ion Proces., 63(1985), p. 273).

Mamyrin et al. demonstrated that a TOF-MS including a reflector used in a reflectron TOF-MS or similar apparatuses can be improved in mass number resolution by employing a configuration that satisfies equation (9): (tld)=0 (see B. A. Mamyrin, V. I. Karataev, D. V. Shmikk and V. A. Zagulin, "The Mass-Reflectron, A New Nonmagnetic Time-Of-Flight Mass Spectrometer With High Resolution", Sov. Phys. JEPT, Vol. 37, No. 1, (1973), p. 45). Their research clearly provides a logical basis for claiming that, as far as the term of (tld) (i.e. the time-focusing condition for energy) is concerned, the focusing condition can be satisfied (i.e. (tld)=0) by providing a reflector on the path between the position at which ions leave the multi-turn loop orbit and the detector and then creating a reflecting electric field with the reflector, even if the time-focusing of ions cannot be achieved within the multi-turn loop orbit.

Figure 2:
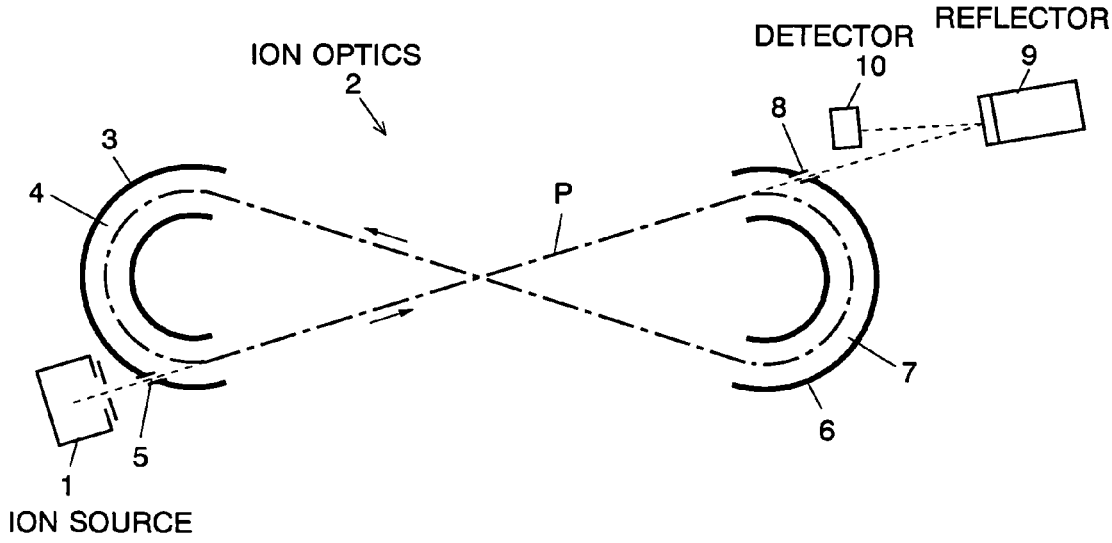
FIG. 2 is a diagram of the overall flight path of the ions including the ion optics of FIG. 1 in the TOF-MS as the embodiment of the present invention.

Illustrated hereby is an embodiment of the present invention, in which the ion optics 2 shown in FIG. 1 is used to configure a flight path as shown in FIG. 2. In this configuration, an ion injecting perforation 5 is formed in the electrode 3, which creates the sector-shaped electric field 4 on the entrance side, and the ion source 1 is disposed on the outside thereof. Also, an ion ejecting perforation 8 is formed in the electrode 6, which creates the sector-shaped electric field 7 on the exit side, and a reflector 9 is disposed on the outside thereof, accompanied by an ion detector 10 located at such a position where it receives ions reflected by the reflector 9. A predetermined level of voltage is applied to both electrodes 3 and 6 by a voltage generating circuit (not shown), thereby creating the sector-shaped electric fields 4 and 7 within the electrodes 3 and 6, respectively. Also, another predetermined level of voltage is applied to the reflector 9 to create an electric field having a predetermined potential gradient whose polarity is the same as that of the ion.

The present system operates as follows. The ions extracted from the ion source 1 utilizing, for example, MALDI (Matrix-assisted Laser Desorption Ionization), initially fly straightforward through the ion injecting perforation 5 and along the straight portion of the "8" shaped loop orbit P. Then the ions, being affected by the sector-shaped electric fields 4 and 7 created within the electrodes 3 and 6, enter the "8" shaped loop orbit P and fly one or more times along the orbit P. When the sector-shaped electric field 7 on the exit side is turned off while the ions fly along the straight portion of the loop orbit P, the ions keep flying straight, pass through the ion ejecting perforation 8 (that is to say, they exit the loop orbit P) and reach the reflector 9. The reflector 9, whose construction is basically the same as that of the reflector used in a reflectron TOF-MS, repels the ions by generating the electric field having a potential gradient whose polarity is the same as that of the ions. At the moment, the ions, which may even have the same mass number, are reflected at deeper positions if they have higher levels of energy, which means the flight distance is practically longer. Accordingly, the ions that have been reflected by the reflector 9 and are heading for the ion detector 10 are more time-focused even if the energy of the ions is dispersed.

Although, in principle, the time-focusing is not necessary for the ion optics 2, it is not recommendable to design the ion optics in such a manner that extremely impairs the time-focusing performance because the compensation by the reflector 9 has some limitation.

Figure 3:
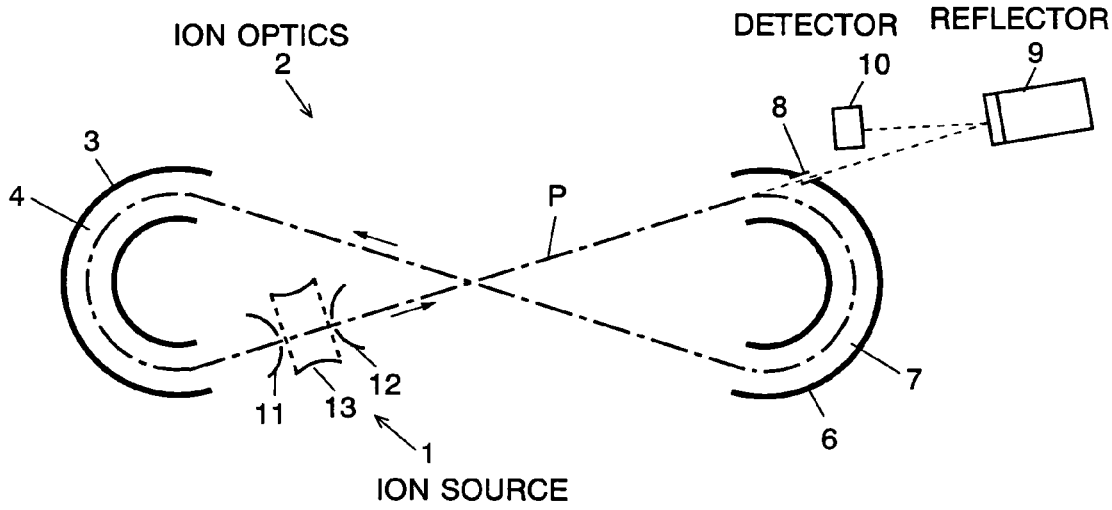
FIG. 3 is a diagram of the overall flight path of the ions in a TOF-MS as a modified embodiment of the present invention.

FIG. 3 is a schematic diagram of the ion path in the TOF-MS according to a modified example of the above-described embodiment. In this configuration, the ion source 1 comprises a three-dimensional quadrupole ion trap composed of a couple of end cap electrodes 11, 12 and a ring electrode 13, with an injecting perforation being formed in the entrance-side end cap electrode 11 and an ejecting perforation in the exit-side end cap electrode 12. For example, ions generated by an external ion generator are introduced into the ion trap, stored therein temporarily and released from the ejecting perforation at a predetermined timing. Since the ion trap is disposed on the loop orbit P, the position at which the ions begin to fly in the ion trap can be regarded as being on the loop orbit P.

Once the ions have been released from the ion trap, the presence of the ion trap can be ignored because the ions now merely enter the ion trap through the injecting perforation and then exit through the ejecting perforation while repeatedly flying along the loop orbit P. In this configuration as well, even if the ions are poorly time-focused due to a dispersion of the energy level and time-focusing is not achieved by the ion optics 2, the ions will be more time-focused when the ions are reflected by the reflector 9, and ions that have left the ion trap with different levels of energy will reach the ion detector 10 at approximately the same time.

Figure 4:
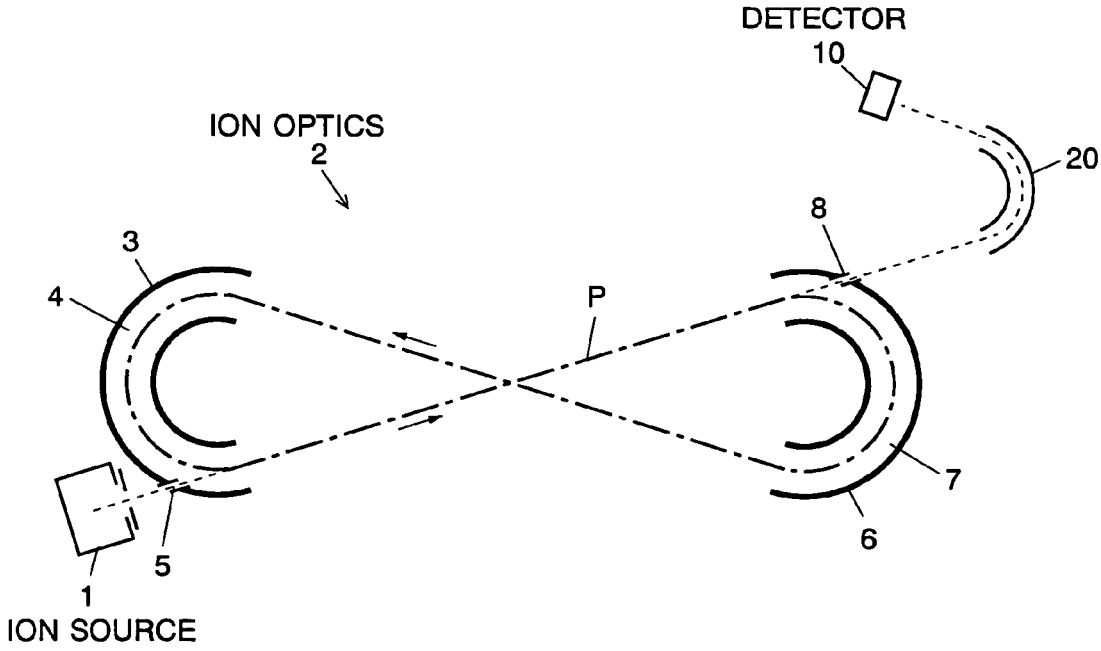
FIG. 4 is a diagram of the overall flight path of the ions in a TOF-MS as another modified embodiment of the present invention.

Instead of the reflector 9, a compensator having a different construction can be provided outside the loop orbit P. FIG. 4 shows an example, in which an electrode 20 for creating a sector-shaped electric field is employed as the compensator. As the ions fly through this sector-shaped electric field, according to the energy the ions have, an ion having a higher level of energy takes an outer flight path, while an ion having a lower level of energy takes an inner flight path. Thereby the flight distance of the two ions differs, the temporal difference is compensated and the ions can reach the ion detector 10 at approximately the same time.

Figure 5:
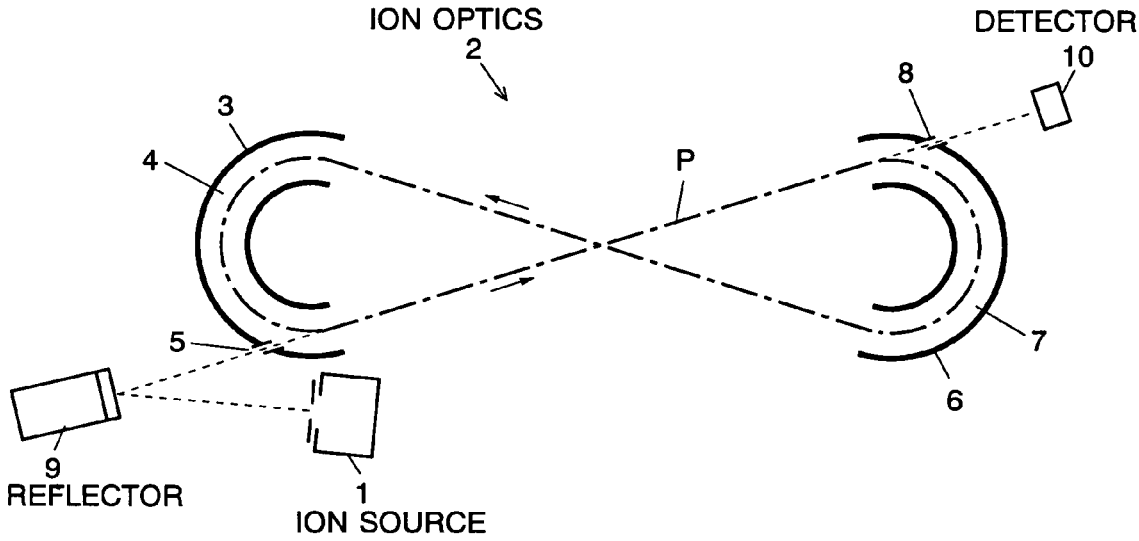
FIG. 5 is a diagram of the overall flight path of the ions in a TOF-MS as another modified embodiment of the present invention.

Moreover, in the above-described embodiments, the compensator such as the reflector 9 or the electrode 20 is provided on the flight path along which the ions travel from the position where they leave the loop orbit P (i.e. the ion ejecting perforation 8) to the ion detector 10, whereas equivalent effects can be obtained by providing a compensator having the same construction as described above on the entrance side where the ions are injected into the loop orbit P, i.e. on the flight path between the ion source 1 and the ion injecting perforation 5. FIG. 5 is an example in which the reflector 9 is provided on the flight path on the entrance side. In this example, the ions having left the ion source 1 are first reflected by the reflector 9, then fly toward the ion injecting perforation 5 and enter the loop orbit P.

The ion optics 2 described in the above-described embodiments is obtained by combining two sector-shaped electric fields. It is also possible for the ion optics 2 to have a different construction; its construction has a large degree of freedom. For example, Matsuda proposed a TOF-MS including a spiral orbit comprising sector-shaped electric fields (see Hisashi Matsuda, "Improvement of a TOF Mass Spectrometer with Helical Ion Trajectory", J. Mass Spec. Soc. Jpn., Vol. 49, No. 6 (2001), p. 227). This type of TOF-MS can also employ the compensator, such as a reflector provided outside the spiral orbit, so as to carry out the time-focusing of ions before they are finally detected. In summary, the track does not need to be designed so that the ions fly along a completely identical path.

The above embodiments are mere examples of the present invention. It should be understood that any change, modification or addition other than the above-described ones may be made within the sprit and scope of the present invention.

What is claimed is:

1. A time of flight mass spectrometer, comprising:

an electric field generator for creating a loop type or reciprocal type of multi-turn track for causing ions to travel in substantially a same path one or more times;

an ion source located on or out of the multi-turn track at which the ions begin to fly;

an ion detector located out of the multi-turn track for detecting the ions that have traveled in the multi-turn track one or more times and left the multi-turn track; and a compensator, located between a position at which the ions leave the multi-turn track and the ion detector or between the ion source and a position at which the ions enter the multi-turn track, for compensating the focusing of ions so as to achieve the time-focusing of the ions throughout an overall flight path along which the ions travel after leaving the ion source until reaching the ion detector.

2. The time of flight mass spectrometer according to claim 1, wherein the compensator is a reflector for creating an electric field that reflects incoming ions.

3. The time of flight mass spectrometer according to claim 1, wherein the compensator is an electrode assembly for creating a sector-shaped electric field.

4. The time of flight mass spectrometer according to claim 1, wherein the multi-turn track is an "8" shaped loop orbit.

5. The time of flight mass spectrometer according to claim 1, wherein the ion source is located on the multi-turn track.

6. The time of flight mass spectrometer according to claim 5, wherein the ion source is a three-dimensional quadrupole ion trap composed of a couple of end cap electrodes and a ring electrode, where the end cap electrodes include an entrance-side end cap electrode with an injecting perforation and an exit-side end cap electrode with an ejecting perforation, and the ions enter the ion trap through the injecting perforation and then exit through the ejecting perforation while repeatedly flying along the loop orbit P.

* * * * *